United States Patent [19]

Yogome et al.

[11] Patent Number: 4,665,873

[45] Date of Patent: May 19, 1987

[54] GOVERNOR FOR FUEL INJECTION PUMP

[75] Inventors: Yoshihiro Yogome; Sheizi Itsuki; Tokuzu Shimizu; Tsutomu Shimizu; Hisashi Hamada, all of Osaka, Japan

[73] Assignee: Yanmar Diesel Engine Co., Ltd., Osaka, Japan

[21] Appl. No.: 800,949

[22] Filed: Nov. 22, 1985

[30] Foreign Application Priority Data

Nov. 30, 1984 [JP] Japan ..... 59-254320

[51] Int. Cl.[4] ..... F02M 39/00

[52] U.S. Cl. ..... 123/373; 123/179 L; 123/365

[58] Field of Search ..... 123/179 L, 373, 372, 123/364, 365

[56] References Cited

U.S. PATENT DOCUMENTS 3,217,700 11/1965 Huse ..... 123/179 L
3,795,232 3/1974 Snook ..... 123/179 L
3,865,091 2/1975 Bostwick ..... 123/179 L
3,884,205 5/1975 Staudt ..... 123/373
4,176,642 12/1979 Shipinski ..... 123/179 L
4,355,609 10/1982 Skinner ..... 123/373
4,479,474 10/1984 Djordjevic ..... 123/179 L

FOREIGN PATENT DOCUMENTS 924713 5/1963 United Kingdom ..... 123/179 L

*Primary Examiner*—Carl Stuart Miller
*Attorney, Agent, or Firm*—Armstrong, Nikaido, Marmelstein & Kubovcik

[57] ABSTRACT

In a double-lever type governor for fuel injection pump providing a governor lever and a tension lever, and securing a start fuel increment stroke in the governor lever by the help of a start spring; a governor for fuel injection pump providing a locking mechanism which connects said both levers at the time when the start fuel increment stroke of the governor lever becomes zero or approximately zero to be eliminated.

4 Claims, 12 Drawing Figures

GOVERNOR FOR FUEL INJECTION PUMP

BACKGROUND OF THE INVENTION

1. Industrial useful field

This invention relates to a governor for a double-lever type fuel injection pump which is equipped with a governor lever and a tension lever and which secures a start fuel increment stroke in the governor lever by the help of a start spring.

2. Prior Art

In this type of governor, a start fuel increment is further increased and the start spring is made operate up to a high rotation speed zone by increasing a spring load of the start spring in order to improve an ignition ability and a rise-up of rotation speed at the time of starting.

However, when the start spring is installed as described above, fuel becomes oversupplied (greater than R2) in FIG. 7 for example, to cause a generation of smoke due to incomplete combustion as shown by a broken line in case when an engine speed is quickly accelerated from a low idling rotation P4 (low rotation speed zone).

On the other hand, when the load of start spring is weakened, the rise-up of engine rotation speed at the time of starting becomes worse.

In order to avoid the fuel oversupply at the time of said quick acceleration, a control device utilizing a bimetal 104 has been developed as shown by FIGS. 10 and 11 (U.S. Pat. No. 4,112,897), for example. Namely, a movement of a fuel regulating rack 105 in a fuel increasing direction is limited to within a prescribed range as shown by FIG. 10 when a temperature is above a bimetal setting temperature (0 degree, for example), and a start fuel increment can be effected as shown by FIG. 11 when a temperature is below the setting temperature.

In such a device, however, the start fuel increment becomes ineffective if this increment operation is required when an engine is to be started at a temperature of above the setting temperature; for example, when the engine is to be restarted after stopping during warm-up running, or when an emergency bolt is used due to inoperable of engagement/disengagement of clutch.

OBJECT OF THE INVENTION

An object of this invention is to improve an ignition ability and a rise-up of rotation speed at the time of startng without being limitted by a temperature, and at the same time to avoid an oversupply of fuel to control a generation of smoke.

MEANS TO COMPLETE THE OBJECT

In order to accomplish said object, a locking mechanism is provided in this invention, which connects a governor lever and a tension lever at the time when a start fuel increment stroke becomes zero or approximately zero, to be eliminated.

BRIEF DESCRIPTION OF THE INVENTION

DETAILED DESCRIPTION OF THE INVENTION

Embodiment

Figure 1:
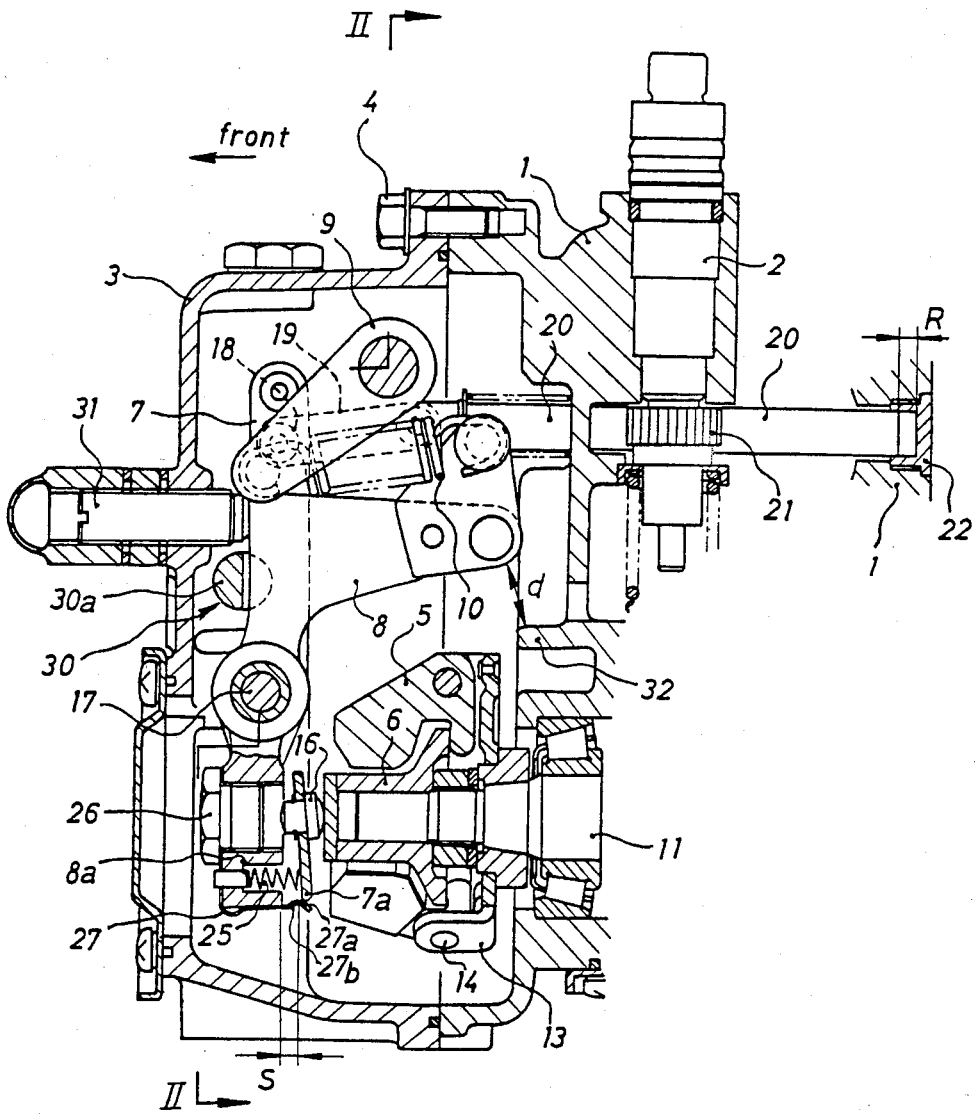
FIG. 1 is a vertical sectional view of a governor according to this invention.

In FIG. 1 showing the vertical sectional view, a fuel injection pump body 2 is inserted into a pump case 1 and a governor case 3 is fastened thereto by plural bolts 4. A governor weight 5, a governor spindle 6, a governor lever 7, a tension lever 8, a regulator lever 9 and a regulator spring 10 etc. are incorporated in the governor case 3. A fuel injection pump actuating cam shaft 11 extends out into the governor case 3, the governor spindle 6 is axially movably supported by its tip end portion, and the governor weight 5 is rotatably supported by a support 13 through a supporting shaft 14. The governor weight 5 engages with the governor spindle 6, and the governor weight 5 expands according to an increase in rotation speed of the cam shaft 11 to push forward the governor spindle 6. A front end of the governor spindle 6 contacts with a pin 16 provided at a bottom end of the governor lever 7.

The governor lever 7 and the tension lever 8 are rotatably supported by a supporting shaft 17, and an upper end of the governor lever 7 is interconnected to a fuel regulating rack 20 through a pin 18 and a link 19. The rack 20 engages with a fuel regulating pinion 21 of the pump body 2, and its tip end faces on a rack stopper 22. The rack stopper 22 is bolted, for example, to the case 1. Incidentally, a clearance R between a bottom face of the rack stopper 22 and a tip end of the rack 20 is designated as a rack movement.

The tension lever 8 is formed into a generally inverted L-shape, a regulator spring 10 is expensively installed between a rear-upper end of the lever 8 and a tip end of the regulator lever 9, and an elastic force of the spring 10 urges the tension lever 8 counterclockwise.

A start spring recession **8*a* is formed at a lower end of the tension lever 8, and a rearward projectingly shaped start spring 25 is disposed in the recession 8*a*. The start spring 25 is compressed between a governor lever lower end 7*a* and the lower end of the tension lever 8, and an elastic force of the start spring 25 pushes the governor lever lower end 7*a* backward, thus a start fuel increment stroke S being secured between the both levers 7 and 8**.

A leaf spring 27, which is a locking mechanism for connecting the both levers 7 and 8, is provided at a bottom edge of the tension lever 8. The leaf spring 27 is formed into a generally L-shape and at the same time fixed to the tension lever 8 by a bolt 26. A guide **27*a* inclining with backside down is formed at a rear end of the leaf spring 27, and a stepped engaging portion 27*b* is formed at a forward side of the guide 27*a***.

30 is a stop lever for stopping an engine, which provides a semi-circular sectional cam portion **30*a*. The cam portion 30*a* faces on front edges of upper halves of the both levers 7 & 8. Namely, the both levers 7 & 8 can be pushed and revolved clockwise by rotating the stop lever 30. Further, the stop lever 30 can be utilized, in combination with said function of the rack stopper 22**, as a locking releasing mechanism.

31 is a fuel limiting bolt which faces on the front edge of the tension lever 8 to limit the maximum counterclockwise rotation amount of the tension lever 8. Further, 32 is a stopper ledge for the tension lever 8, which faces on a rear edge of the tension lever 8 from lower back side with a clearance d left therebetween to limit a clockwise rotation amount of the tension lever 8.

Figure 2:
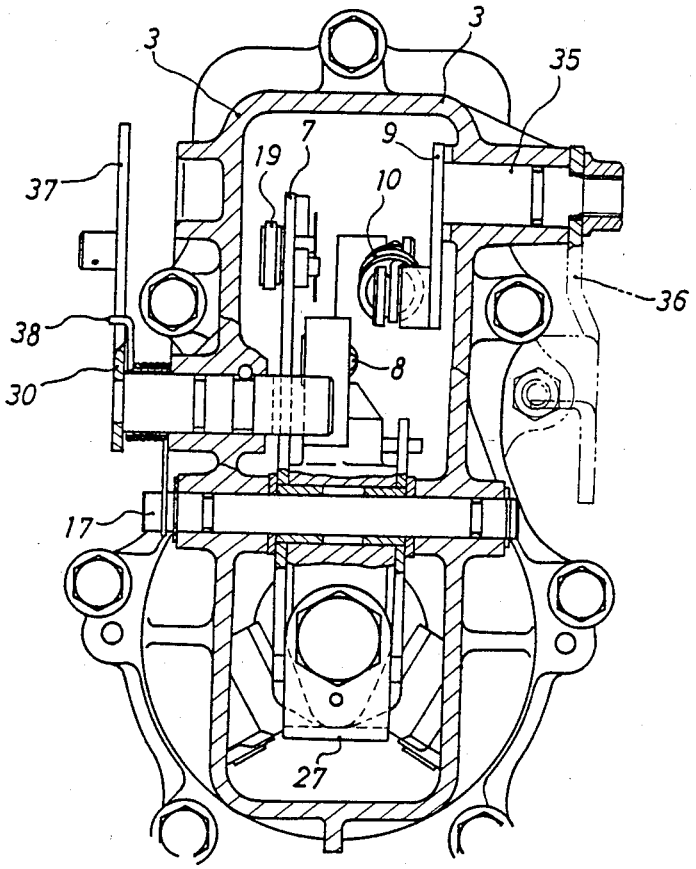
FIG. 2 is a sectional view taken on a line II—II of FIG. 1.

The regulator lever 9 is fixed to a rotating shaft 35 as shown in FIG. 2, the rotating shaft 35 is supported rotatably by the case 3 and extends out of the case 3, and a regulator handle 36 is fixed to its tip end. The stop lever 30 is also supported rotatably by the case 3 and extends out of the case 3, and a stop handle 37 is fixed to its tip end. The stop lever 30 is held by a return spring 38 to a rotating position as shown by FIG. 1, that is, a position where a plane portion of a semi-circular functioning part 30*a* faces on and in parallel with the front edges of the levers 7 & 8.

Figure 3:
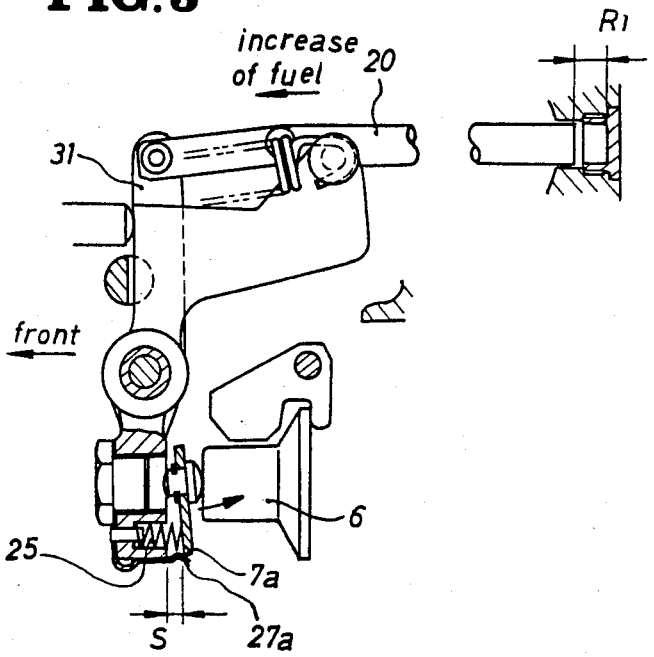
FIG. 3 through FIG. 6 are function explanatory drawings showing different situations respectively.
Figure 4:
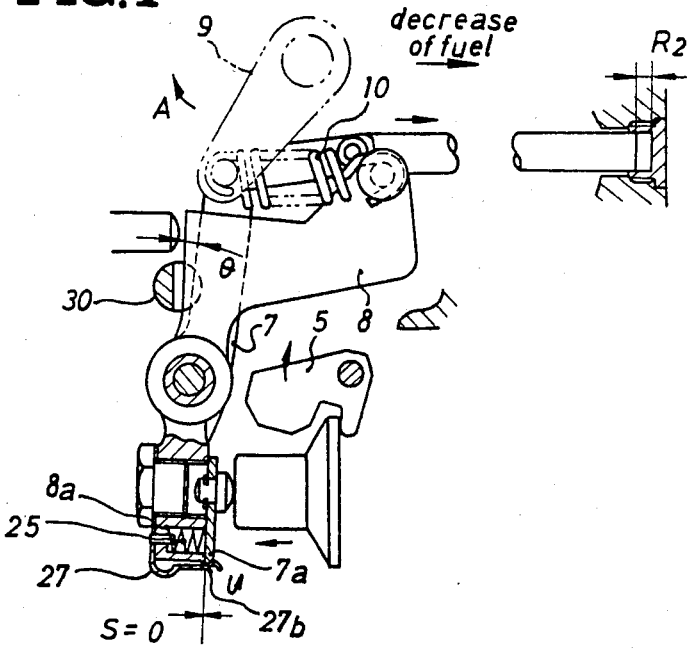
Figure 5:
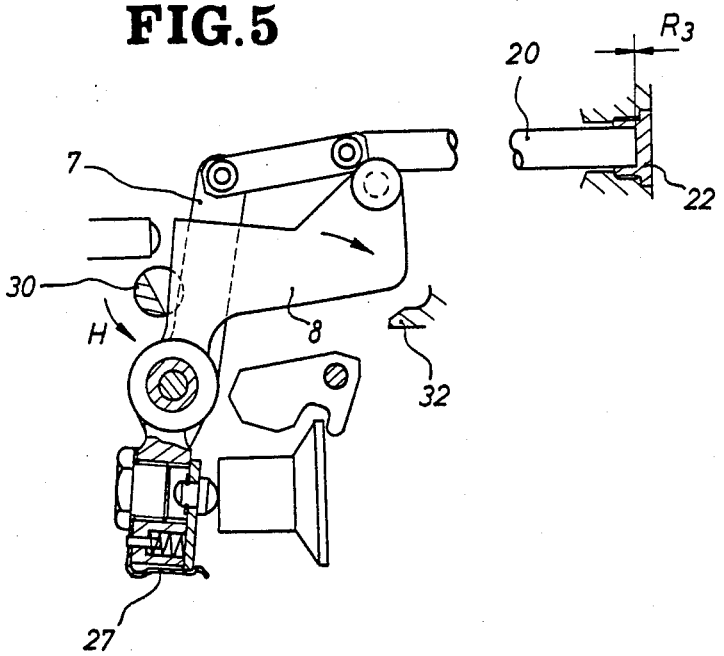
Figure 6:
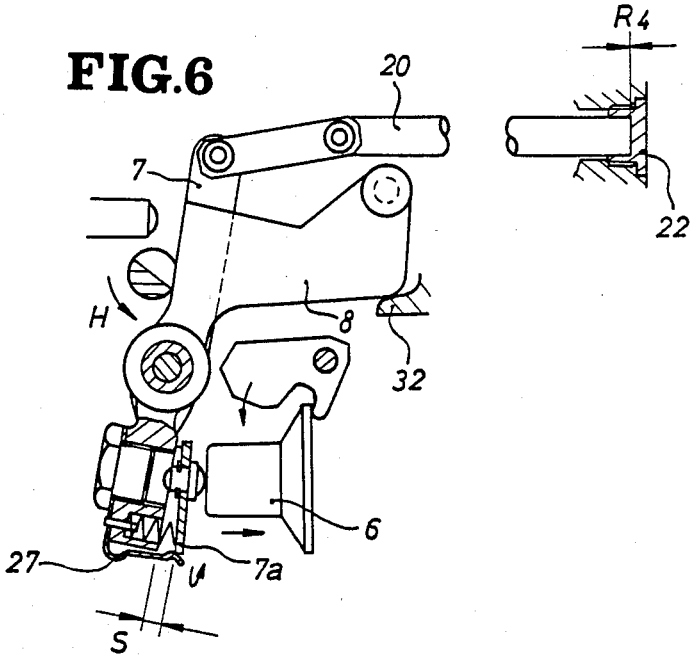
Figure 7:
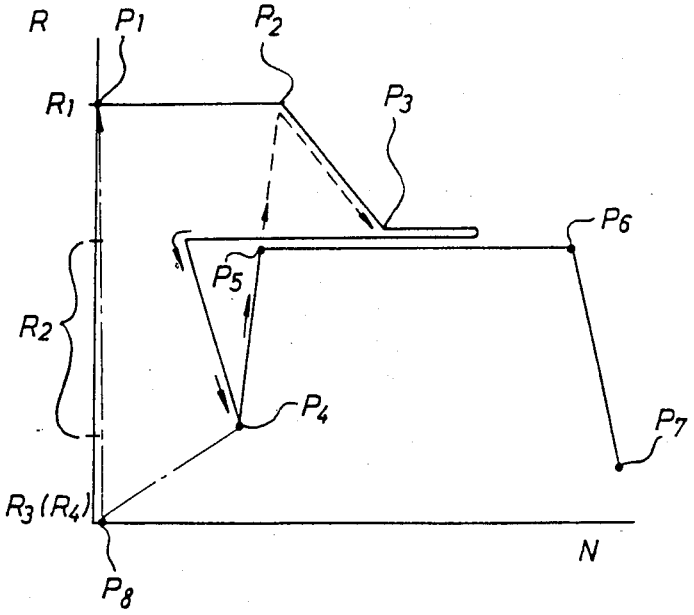
FIG. 7 is a graph showing a relation between a rack movement and an engine rotation speed.

FIG. 3 shows a starting position, FIG. 4 shows a normal operation position, FIG. 5 shows a stop operation commencing position, and FIG. 6 shows a stop operation completed position, respectively. FIG. 7 is a graph showing a relation between a rack movement R and an engine rotation speed N.

Function of the Invention

At the time of engine start of FIG. 3, the governor lever lower end 7*a* is pushed out backward by the elastic force of the start spring 25, thereby the start fuel increment stroke S being secured. Consequently, the rack 20 is pulled forward (fuel increasing side) largely and a fuel injection quantity increases to provide an easy starting (from P1 to P2 of FIG. 7). With an increase in engine rotation speed, the governor spindle 6 moves forward to push forth the governor lever lower end 7*a* against the start spring 25, thus minimizing the start fuel increment stroke S. In this instance the bottom edge of the governor lever lower end 7*a* contacts with the guide 27*a* of the leaf spring 27 to push open the guide 27*a* downward (from P2 to P3 of FIG. 7).

In FIG. 4, when the governor lever lower end 7*a* contacts with the lower end of the tension lever 8, the bottom edge of the governor lever lower end 7*a* fits in an engaging section 27*b* of the leaf spring 27 and the both levers 7 & 8 become integrated by the elastic force of the leaf spring 27. Namely, the start fuel increment stroke S of the governor lever 7 becomes zero or approximately zero to be eliminated and at the same time the both levers 7 & 8 becomes to rotate integrally. After the both levers 7 & 8 are connected as shown by FIG. 4, the rotation speed is controlled by a balance of the regulator spring 10 and a thrust force of the governor weight 5. For example, the speed converges on a low-idling rotation speed (approximately about 650 rpm) shown by P4 of FIG. 7.

Under a state shown in FIG. 4, the start spring 25 does not function even if the regulator lever 9 is turned to the maximum rotation side (arrow A side) to quickly accelerate the rotation speed from the low-idling rotation speed (low rotation speed zone), so that fuel does not become oversupplied. Namely, in FIG. 7, since the start fuel increment stroke of the governor lever 7 has become zero or approximately zero to be eliminated; the rack movement is restricted at the maximum point P5 within the range of R2, fuel does not increase beyond that point, the oversupply of fuel is prevented and the generation of smoke is controlled; even if the rotation is quickly accelerated from the low-idling rotation speed P4. Incidentally, P6 indicates the maximum rotation speed at full load and P7 indicates a high-idling rotation speed.

Further, under a state wherein the both levers 7 & 8 are connected as shown in FIG. 4; the front edge of the governor lever 7 deviates backward relatively to the front edge of the tension lever 8 by an angle $\theta$ corresponding to the start fuel increment stroke.

An engine stop operation using the stop lever 30 and an automatic locking release function accompanied thereby will be described hereunder.

In FIG. 5, the both levers 7 & 8 rotate integrally clockwise when the stop lever 30 is started turning in a direction of arrow H, and the movement of the rack 20 and the rotation of the governor lever 7 are restrained and at the same time fuel supply is cut off and the engine is stopped when the rear end of the rack 20 contacts with the rack stopper 22 (from P4 to P8 of FIG. 7). When the stop lever 30 is further turned in the direction of arrow H under a state of the governor lever 7 being restrained, the tension lever 8 rotates clockwise relatively to the governor lever 7, thereby the bottom edge of the governor lever lower end 7a gets out of the leaf spring 27 to secure the start fuel increment stroke S again as shown in FIG. 6. Further, when the rear edge of the tension lever 8 contacts with the stopper ledge 32, the maximum clockwise rotation amount of the tension lever 8 is restricted. Then, when the stop lever 30 is returned in the direction opposite to arrow H, the state of before starting the engine of FIG. 3 is recovered (from P8 to P1 of FIG. 7).

Figure 9:
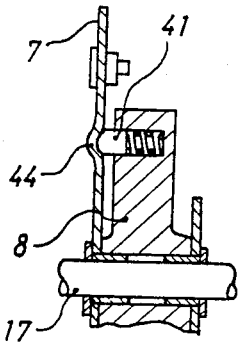
FIG. 9 is a vertical sectional view of the same part as FIG. 8 showing a locked condition.
Figure 8:
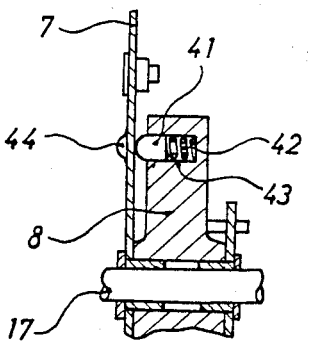
FIG. 8 is a vertical sectional view of another embodiment.
Figure 10:
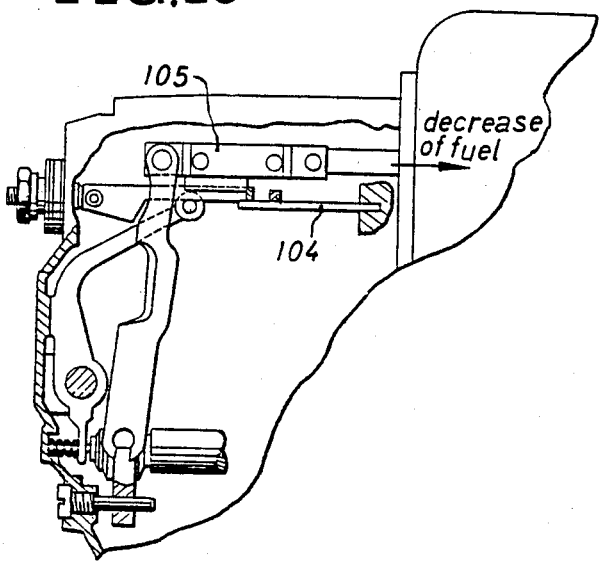
PRIOR ART FIG.10
FIGS. 10 & 11 are vertical sectional views of conventional embodiment.
Figure 11:
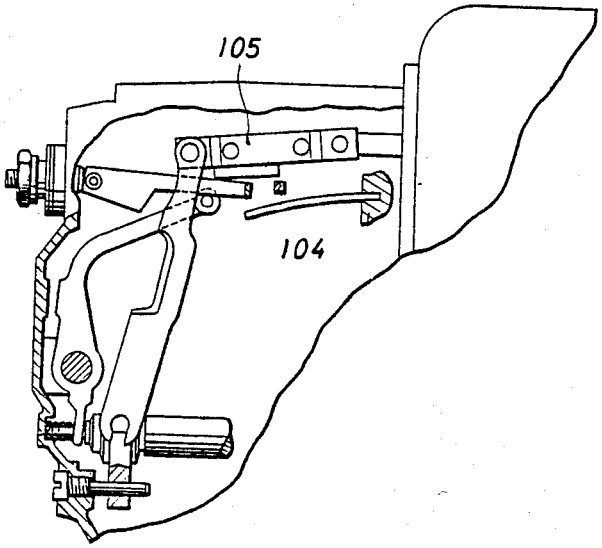
PRIOR ART FIG.11

Other embodiments (1) An embodiment shown in FIG. 8 is one in which a locking pin 41 and a detent spring 42 are used for the locking mechanism. Namely, the pin 41 is inserted in a lateral hole 43 of the tension lever 8, and the pin 41 is made contact with a side face of the governor lever 7 with a prescribed pressure by the spring 42. A locking recession 44 is formed on the side face of the governor lever 7. When the start fuel increment stroke (S of FIG. 1) of the governor lever 7 becomes zero or approximately zero to be eliminated, the pin 41 fits in the recession 44 to lock the both levers 7 & 8 for integral rotation as shown in FIG. 9. Construction other than the locking mechanism are the same as the governor of FIG. 1.

(2) The pin 41 and the spring 42 of FIG. 8 may be provided in the governor lever 7, and the locking recession 44 may be provided in the tension lever 8.

(3) In FIG. 1, this invention is applied to the governor in which the compressed start spring 25 is installed. However, the present invention is also applicable to the governor (Japan Utility Model No. 52-57296) in which the start fuel increment stroke is secured by a tension-type start spring.

Figure 12:
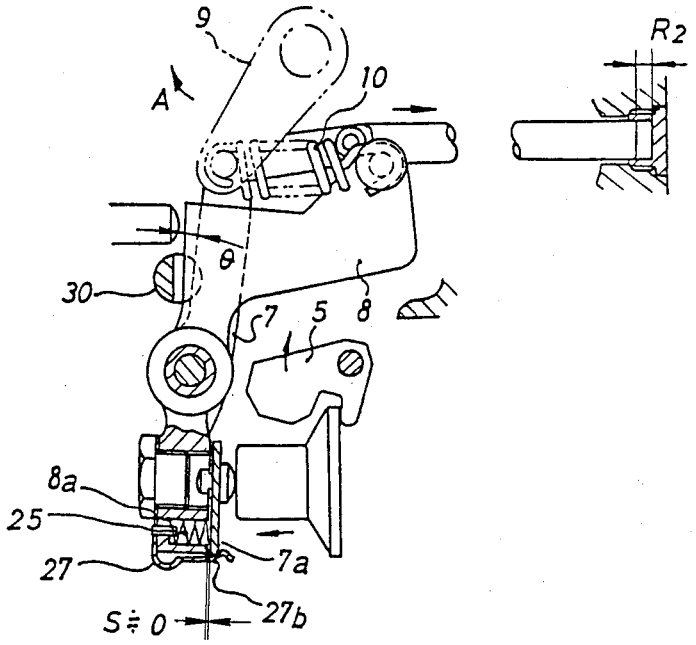
FIG. 12 is a vertical sectional view of a further another embodiment.

(4) Such a construction may be employed that the governor lever 7 has a slight clearance in relation to the tension lever 8 under the locked state as shown by FIG. 12. Namely, the start fuel increment stroke may be deviced to become approximately zero under the locked state.

Effect of the Invention

As described above, in the governor for the doublelever type fuel injection pump wherein the start fuel increment stroke S is provided between the governor lever 7 and the tension lever 8 by compressively installing the start spring 25 between the both levers 7 & 8; the locking mechanism (the leaf spring 27, for example) is provided which connects the both levers 7 & 8 when the start fuel increment stroke S of the governor lever 7 becomes zero or approximately zero to be eliminated, so that the good rise-up of rotation can be secured by the function of the start spring 25 at the time of starting, and moreover the oversupply of fuel can be prevented and the generation of smoke due to incomplete combustion can be controlled by the function of the locking mechanism after the engine is started.

Namely, the rise-up performance of engine at the time of starting can be improved by increasing the rigidity of the start spring 25. While, the oversupply of fuel can be prevented and the generation of smoke due to incomplete combustion can be controlled at the time when the speed is quickly accelerated from the low-rotation speed zone.

What is claimed is:

1. A double-lever type governor for a fuel injection pump comprising:

a governor case;

a governor lever and a tension lever rotatably supported in the case and operatively associated with each other;

a start spring interposed between the governor lever and the tension lever securing a start fuel increment stroke in the governor lever;

a fuel regulating rack connected to the governor lever;

a supporting shaft mounted in the case supporting both the governor lever and the tension lever for rotation; and a locking mechanism which connects both levers at the time when the start fuel increment stroke of the governor lever becomes zero or approximately zero to be eliminated, said start spring being compressively installed between a portion of the governor lever contacting with a governor sleeve and the tension lever; said locking mechanism comprising a leaf spring provided on the tension lever having an engaging part formed at a tip end thereof, the governor lever being made freely engaged with and disengaged from said engaging part.

2. A double-lever type governor for a fuel injection pump comprising:

a governor case;

a governor lever and a tension lever rotatably supported in the case and operatively associated with each other;

a start spring interposed between the governor lever and the tension lever securing a start fuel increment stroke in the governor lever;

a fuel regulating rack connected to the governor lever; and a locking mechanism which connects both levers at the time when the start fuel increment stroke of the governor lever becomes zero or approximately zero to be eliminated, said locking mechanism comprising a locking pin inserted in a hole in one of the tension levers and the governor lever, a detent spring in said hole biasing said locking pin with a prescribed pressure into contact against a side face of the other of the tension lever and the governor lever, and a recession in the side face of the other of the tension lever and the governor lever into which the locking pin fits to lock both levers for integral rotation.

3. A governor for fuel injection pump as set forth in claim 1, in which a stop lever which pushes back the governor lever to a fuel decreasing side is rotatably provided as a locking release mechanism in the governor case, a rack stopper limiting a fuel stop position of the fuel regulating rack is provided, the stop lever is made freely contact also with the tension lever, and the engagement between the leaf spring and the governor lever can be released in such a way that the stop lever is revolved to swing the tension lever and the governor lever until the governor lever gets to the fuel stop position, then the stop lever is further revolved to swing the tension lever.

4. A governor for fuel injection pump as set forth in claim 2, in which a stop lever which pushes back the governor lever to a fuel decreasing side is rotatably provided as a locking releasing mechanism in the governor case, a rack stopper limitting a fuel stop position of the fuel regulating rack is provided, the stop lever is made freely contact also with the tension lever, and the engagement between the locking pin and the governor lever can be released in such a way that the stop lever is revolved to swing the tension lever and the governor lever until the governor lever gets to the fuel stop position, then the stop lever is further revolved to swing the tension lever.

* * * * *